US006885614B2

(12) United States Patent
Rey-Mermet

(10) Patent No.: US 6,885,614 B2
(45) Date of Patent: Apr. 26, 2005

(54) MOON PHASE DISPLAY DEVICE, PARTICULARLY FOR A TIMEPIECE

(75) Inventor: Gilles Rey-Mermet, Le Landeron (CH)

(73) Assignee: Asulab S.A., Marin (CH)

( * ) Notice: Subject to any disclaimer, the term of this patent is extended or adjusted under 35 U.S.C. 154(b) by 0 days.

(21) Appl. No.: 10/834,274

(22) Filed: Apr. 29, 2004

(65) Prior Publication Data

US 2004/0223413 A1 Nov. 11, 2004

(30) Foreign Application Priority Data

May 5, 2003 (EP) ..... 03010126

(51) Int. Cl.[7] ..... G04B 19/26; G04B 23/00
(52) U.S. Cl. ..... 368/16; 368/18; 434/284
(58) Field of Search ..... 368/16–20, 28, 368/37; 434/282, 284

(56) References Cited

U.S. PATENT DOCUMENTS

| | | | | |
|---|---|---|---|---|
| 508,467 A | | 11/1893 | Clark | |
| 1,997,511 A | * | 4/1935 | Canepa | 368/18 |
| 4,853,908 A | * | 8/1989 | Bourquin et al. | 368/19 |
| 5,023,849 A | * | 6/1991 | Vaucher | 368/15 |
| 5,086,416 A | * | 2/1992 | Dubois et al. | 368/18 |
| 6,507,536 B1 | | 1/2003 | Keatch | |

FOREIGN PATENT DOCUMENTS

| | | |
|---|---|---|
| EP | 0869411 A2 | 10/1998 |
| EP | 1103872 A1 | 5/2001 |

OTHER PUBLICATIONS

Glaser, G., "Astronomische Indikationen Bei Uhren," Jahrbuch der Deutschen Gesellschaft fur Chronometrie, Deutschen Gesellschaft fur Chronometrie E.V. Stuttgard, DE, vol. 40, 1989, pp. 139–161.

European Search Report for EP 03010126, in English, completed at the Hague on Feb. 19, 2004, by U. Exelmans.

European Search Report for EP 03010126, in French, completed at La Haye, on Fevrier 19, 2004, by U. Exelmans.

* cited by examiner

*Primary Examiner*—Vit W. Miska
(74) *Attorney, Agent, or Firm*—Griffin & Szipl, P.C.

(57) ABSTRACT

The device includes an indicator (3) in the shape of a plate, moving behind a dial (1) having a circular aperture (2), which represents the lunar disc. The indicator includes an S-shaped line of separation (6) between a dark zone (4) and a light zone (5) representing the non-illuminated part and the illuminated part of the moon in the aperture. The indicator is rotatably mounted at the centre of symmetry C of the line of separation (6) on a rotating support making two revolutions per lunation. An image matching the appearance of the moon in each phase is thus obtained. Such a device can be used particularly in a watch or another timepiece.

9 Claims, 8 Drawing Sheets

MOON PHASE DISPLAY DEVICE, PARTICULARLY FOR A TIMEPIECE

This application claims priority from European Patent Application No 03010126.5 filed May 5, 2003, the entire disclosure of which is incorporated herein by reference.

TECHNICAL FIELD

The present invention concerns a device for displaying the phases of the moon, particularly in a watch or other timepiece, including a dial provided with a circular aperture, a mobile indicator in the shape of a plate, moving behind the dial and having a substantially S-shaped separation line between a dark zone and a light zone which can be seen through the aperture, the indicator having a pivoting axis that passes through a centre of symmetry of the separation line, an entry element rotatably mounted on a plate and making a determined number of revolutions per lunation, and a transmission mechanism assuring a kinematic connection between the entry element and the indicator.

BACKGROUND OF THE INVENTION

In conventional moon phase display devices, a disc bearing two images of the full moon makes one half-revolution per lunation behind a semi-circular window of a peculiar shape, illustrated for example in U.S. Pat. No. 508,467. One of the edges of the window includes two convex arcs that cut into the image of the full moon, respectively while the moon waxes and wanes. The shape of the moon image thus displayed is correct only at the beginning and at the end of the lunation (starting from the new moon), when the illuminated part has the shape of a crescent, and at the full moon. During the other phases, the image displayed has an incorrect shape, because the shape of the line of separation between the light zone and the dark zone does not conform to reality: it is curved instead of being straight at the first and last quarter, and it is bent in the wrong direction between the first and the last quarter.

Various solutions have been proposed to avoid this drawback.

A display device of the kind indicated hereinbefore in the preamble is disclosed in U.S. Pat. No. 6,507,536 and includes two partially superposed rotating discs, each bearing a dark zone limited by a curve. The rest of the upper disc is transparent to show a part of the lower disc, outside the phase of the new moon. The two discs are synchronously driven by gears. Their respective dark zones are combined behind the window to give, at each phase of the moon, an image in which the shape of the light window to give, at each phase of the moon, an image in which the shape of the light zone corresponds as far as possible to that of the moon seen from the earth. Such a device is relatively bulky in plane. At the phases where the separation line is formed by a combination of the dark zones of the two discs, one cannot always avoid the appearance of a break in said line at the place where the edges of the two dark zones intersect. Moreover, the image of the moon can only be formed in one plane, since it is formed of two parts that are offset mutually in depth in the direction of vision, and this constitutes a drawback from an aesthetical point of view.

In EP Patent Application No. 1 103 872, the moon is represented by a transparent circular disc that moves linearly in front of a dark screen having a sinuous elongated aperture. The width of the aperture varies from a maximum at the middle, corresponding to the diameter of the lunar disc, to zero at the ends. The lunar disc moves pressing against a sinuous cam surface, such that one of the edges of the aperture is tangent to the disc and the other edge forms a line of separation almost matching reality, between the light part and the dark part of the lunar disc. However, the device disclosed in this document is too bulky to be incorporated in a watch. Further, such a display is difficult to read if it is not lit from behind.

SUMMARY OF THE INVENTION

The present invention concerns a device for displaying the phases of the moon largely avoiding the drawbacks of the prior art and showing, in a circular aperture, an image of the light zone and the dark zone of the moon which is as close as possible to reality. An additional object is to show the two aforementioned zones in the same plane.

The invention therefore concerns a display device of the type indicated in the preamble, characterized in that the transmission mechanism includes a rotating support making two revolutions per lunation and whose rotational axis is off-centre with respect to the aperture, in that the indicator is rotated so as to pivot at one point of the rotating support whose trajectory passes through the centre of the aperture, and in that said kinematic connection is arranged such that the indicator completes one revolution per lunation with respect to the dial.

With respect to the device illustrated by U.S. Pat. No. 6,507,536, this arrangement is distinguished mainly by the use of a single mobile indicator, the movement of which is more complex than the simple rotating movement provided in said Patent. On the one hand, this allows the S-shape of the line of separation and the movements of the indicator member to be combined in an optimum manner with respect to the position and size of the aperture, so that the part of the line of separation visible in the aperture corresponds as closely as possible to reality. On the other hand, the light zone and the dark zone of the indicator member can advantageously be located in the same plane.

Moreover, this arrangement allows a particularly advantageous embodiment which is characterized in that the movement of the indicator during a lunation includes a first and a third step during which the indicator moves without substantially rotation with respect to the dial, and a second and a fourth step during each of which the indicator moves by substantially rotating through a half-revolution with respect to the dial. Owing to this combination of movements of translation and rotation, it is possible to make the image displayed change as a function of time in a way that imitates as far as possible the changing appearance of the moon as a function of time.

BRIEF DESCRIPTION OF THE DRAWINGS

Other features and advantages of the present invention will appear in the following description of a preferred embodiment and of various variants, used as non-limiting examples, with reference to the annexed drawings, in which.

EMBODIMENTS OF THE INVENTION

Figure 1:
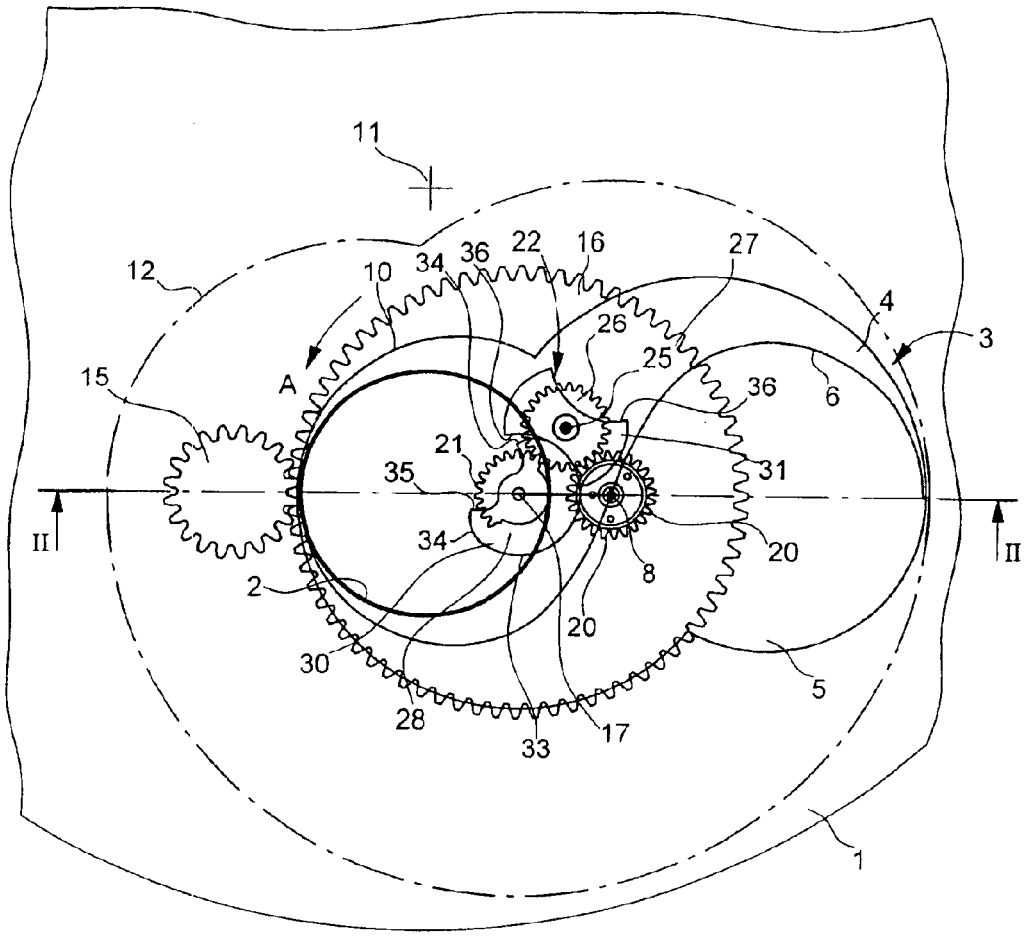
FIG. 1 is a transparent plane view of the mechanism of a preferred embodiment of a device for displaying the phases of the moon according to the invention, intended to be driven by a watch movement.

With reference to FIGS. 1 to 4, the moon phase display device includes a dial 1, which can be the dial of a watch in which the device is fitted, this dial having a circular aperture 2 through which the observer can see a mobile indicator 3 in the shape of a plate, which moves in its own plane just behind dial 1. The upper surface of indicator 3 is subdivided into a dark zone 4 and a light zone 5 which are separated from each other by an approximately S-shaped sinuous line 6, as can be seen more clearly in FIG. 5. The line of separation 6 has rotational symmetry with respect to its central point of inflexion C. Point C coincides with a axis of pivoting 8 of indicator 3. Preferably, dark zone 4 is black and light zone 5 is the yellow colour usually used in s displays of the phases of the moon, but other colours can be used. The terms "dark" and "light" employed here to qualify zones 4 and 5 of the indicator have only a relative value and should not be interpreted as qualifying shades or colours capable of representing the parts of the moon that are respectively not illuminated and illuminated by the sun.

The external contour 10 of indicator 3 plays no particular role and has here approximately the shape of an 8. The shape shown in the drawings is chosen so as to minimise the space occupied by the indicator during its movement, while guaranteeing that contour 10 will never be visible in aperture 2. Line 12 visible in FIG. 1 shows the external limit of the area travelled by indicator 3. Its shape enables aperture 2 to be placed relatively close to centre 11 of dial 1, where the shafts of the hands of the watch are usually located. As can be seen more clearly in FIG. 5, each of zones 4 and 5 of the indicator includes an approximately circular head 4*a*, 5*a*, which is larger than aperture 2, so as to be able to cover the surface of the latter entirely to represent the new moon and the full moon, and a bent and tapered tail 4*b*, 5*b* whose minimum width from each point of line of separation 6 is chosen such that contour 10 does not appear in the aperture. At the limit between the head and the tail, the largest width of the tail is only slightly greater than the radius of the aperture. Contour 10 has, at this. point, a re-entrant angle that limits the area 12 covered by indicator 3, especially in the vicinity of the dial centre 11.

Figure 2:
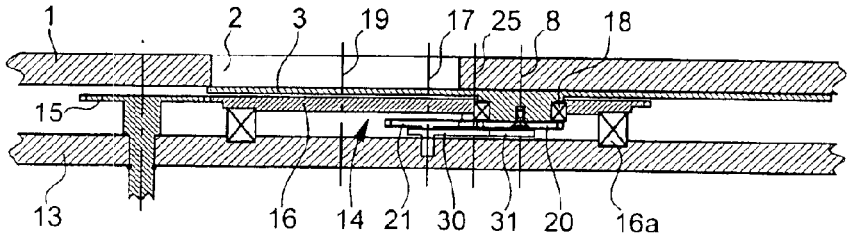
FIG. 2 is a cross-section along the line II—II of FIG. 1.
Figure 3:
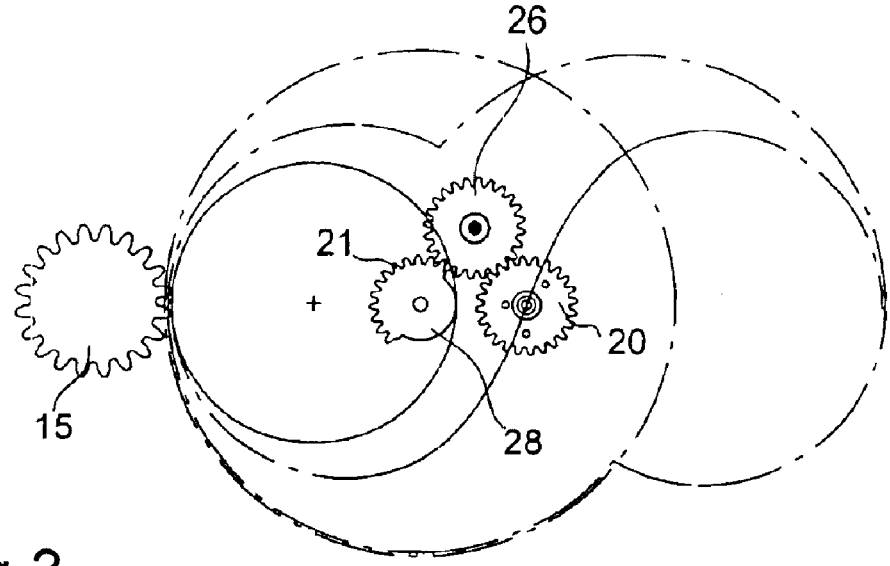
FIGS. 3 and 4 show plane views of different levels of the mechanism shown in FIGS. 1 and 2.
Figure 4:
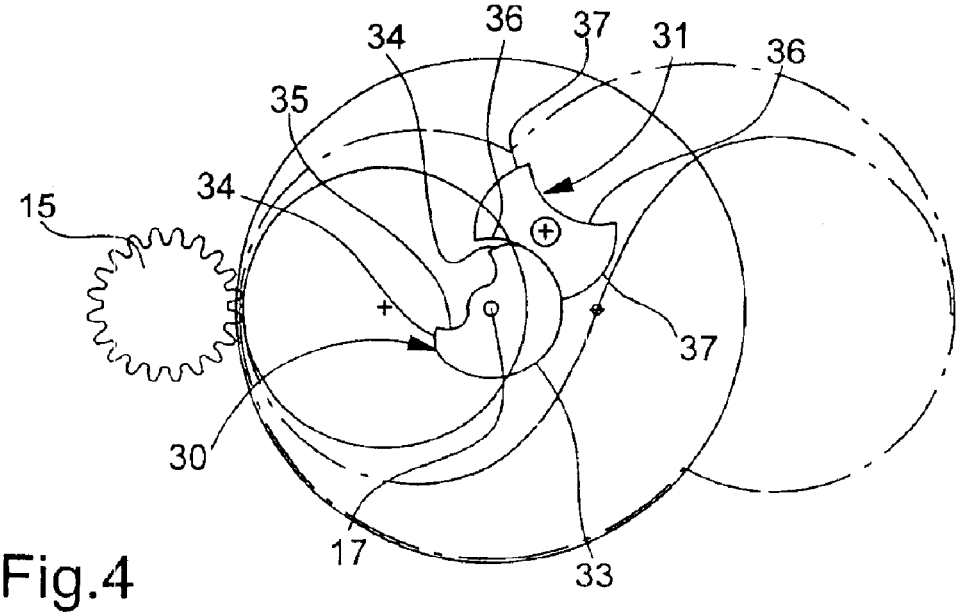

As can be seen particularly in FIG. 2, indicator 3 is supported and driven by a mechanism 14 mounted on a plate 13 of a watch movement. Mechanism 14 includes as entry element a pinion 15 meshed with the peripheral toothing of a rotating support plate 16, which extends below indicator 3 and rotatably mounted in plate 13 by means of a ball bearing 16*a*. Plate 16 is driven in rotation about its axis 17 by the watch movement via pinion 15 so as to make two revolutions per synodic lunation, i.e. in around 29.53 days.

Gear arrangements for obtaining such a period of revolution from the hour wheel of a watch movement are well known and various variants thereof can be found in horological literature. In many calendar watches, the moon phase indicator is driven through one step each day by a finger of a drive wheel set which makes one revolution per day and which also drives a date indicator. One wheel of such a wheel set can drive the device of the present invention, with a transmission ratio as close as possible to the number of days of a half lunation, which is an average of 14.7652940 days. The relatively large diameter of plate 16 is an advantage in this respect, because it enables it to be given quite a large number of teeth, thus facilitating gear reduction.

With the toothings shown in FIG. 1, the transmission ratio of pinion 15 to plate 16 is 25:72. The driving of pinion 15 from the date drive wheel set, making one revolution per day anti-clockwise, is carried out with the ratio 8:41, which gives an overall ratio of 25:369=1:14.7600. The deviation with respect to the theoretical mean value is three times less than with the usual ratio of 1:59.

An even more accurate solution consists in giving pinion 15 and plate 16 respectively 9 and 46 teeth, and driving pinion 15 from the aforementioned drive wheel set with a ratio of 9:26, which gives an overall ratio of 81:1196=1:14.765432 and a deviation of less than 5 minutes per year. Thus, the deviation between the moon phase indicator and the calendar only exceeds one whole day after three centuries.

Indicator 3 is mounted so as to pivot about its axis 8 at an off-centre point of plate 16, for example by means of a ball bearing 18 which holds the indicator in a parallel position to the plate. Indicator axis 8 is arranged such that its circular trajectory from central point C and separation line 6, passes through axis 19 of aperture 2 and thus also through the centre D (FIG. 5) of the aperture.

Mechanism 14 further includes means for orienting indictor 3 with respect to dial 1. In the preferred embodiment described here, these means are dual and operate alternately: first orientation means hold indicator 3 in a constant orientation during a half-revolution of plate 16, whereas second orientation means block the pivoting of indicator 3 on plate 16 and thus cause it to rotate with the latter during its second half-revolution.

The first orientation means include a toothed wheel 20 secured to indicator 3, a toothed wheel 21 secured to plate 13 and a satellite wheel set 22 having a shaft rotatably mounted in plate 16 by a ball bearing so as to be able to rotate about its axis 25. Wheel set 22 includes a toothed wheel 26, permanently meshed with wheel 21 and only extends over a little more than half of the circumference, whose remaining portion 28 is smooth and set back so as not to touch wheel 26. The primitive diameters of toothed wheels 20, 21 and 26 are equal, such that when plate 16 carries out a half-revolution, for example in the direction of arrow A, wheel 26 and thus wheel set 22 make a half-revolution in the same direction. Since wheels 20 and 26 also have equal diameters, wheel 20 and indicator 3 make a half-revolution at the same time in the opposite direction to plate 16. When the latter carries out a half-revolution, the effect of the half-revolution of the indicator in the opposite direction is that the indicator rotates with respect to the fixed elements such as dial 1 and plate 13. In other words, the indicator then moves without changing orientation, carrying out a translation along the semi-circular trajectory of its axis 8. At that moment, wheel 26 reaches the end of toothing 21 and will be released therefrom during the second half-revolution of plate 16, during which the second orientation means will act.

The second orientation means include a fixed cam 30, arranged between the fixed wheel 21 and plate 13, and a rotating cam 31, which forms part of satellite wheel set 22.

Cam 30 has a substantially circular cam surface 33, centred on axis 17, whose ends are extended by two arcs 34 of smaller radius, between which cam 30 exhibits a recess 35. Cam 31 is formed by a disc into which two symmetrical recesses are cut, forming cam surfaces 36 of the same radius as surface 33 of cam 30. Cam 31 thus has the approximate shape of a double H, whose ends 37 can be engaged in recess 35 of cam 30 while toothed wheels 21 and 26 are meshed.

At the moment when toothed wheel 26 of satellite wheel set 22 is released from the toothing of wheel 21, one of cam surfaces 36 of cam 31 slides against cam surface 33 of fixed cam 30. Thus, during the next half-revolution of plate 16, the pivoting of wheel set 22 and indicator 3 on plate 6 is blocked, such that the indicator rotates in one unit with the plate. It thus rotates through a half-revolution with respect to dial 1 during the second half-revolution of the plate. Then, wheel 26 again meshes with wheel 21 and the cycle starts again. Indicator 3 will again carry out a half-revolution with respect to the dial during the next complete revolution of plate 16.

The movements described hereinbefore of indicator 3 during two revolutions of plate 16, i.e. one lunation, result in the positions shown in FIGS. 5 to 12. In these drawings, dial 1 is assumed to be transparent to allow the positions of the indicator to be better seen, but in practice, it is evidently opaque and an observer can only see the part of indicator 3 located behind aperture 2 and forming an image of the different phases of the moon.

Figure 5:
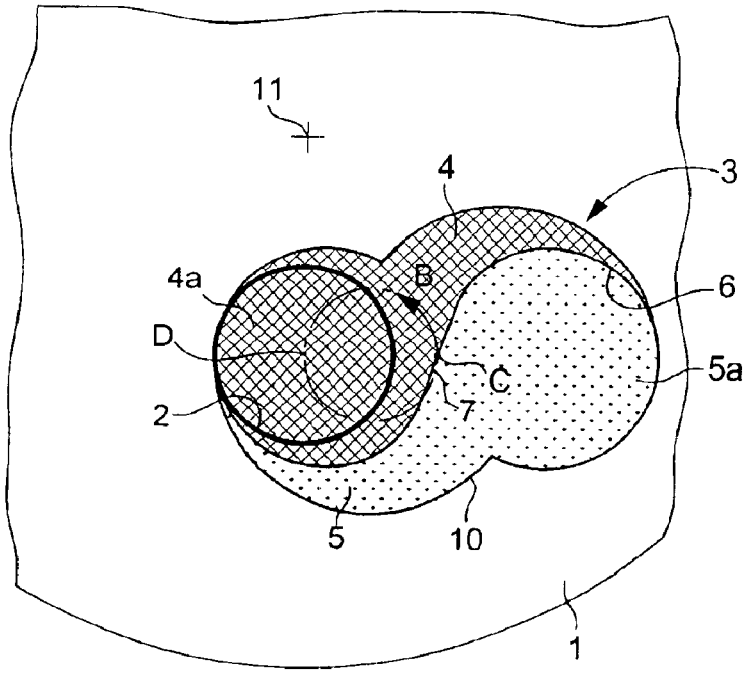
FIGS. 5 to 12 show eight successive positions of the indicator of the display device, corresponding to the phases of the moon each offset by one eighth of the duration of a lunation.

FIG. 5 shows the new moon phase, where only dark zone 4 is visible in aperture 2. Centre C of the indicator is then located outside the aperture, as is the whole of separation line 6. At this phase, wheel 26 starts to mesh with fixed wheel 21 and indicator 3 will thus move without pivoting while its centre C moves as indicated by arrow B.

Figure 6:
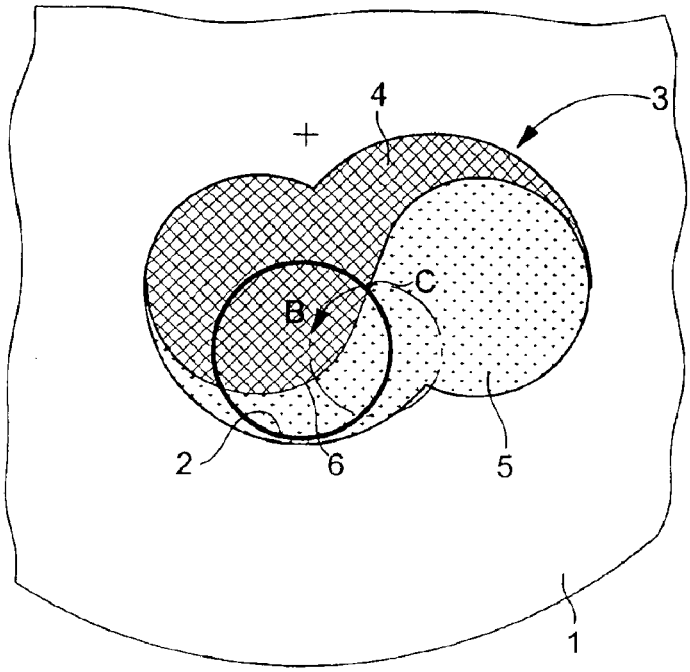
Figure 7:
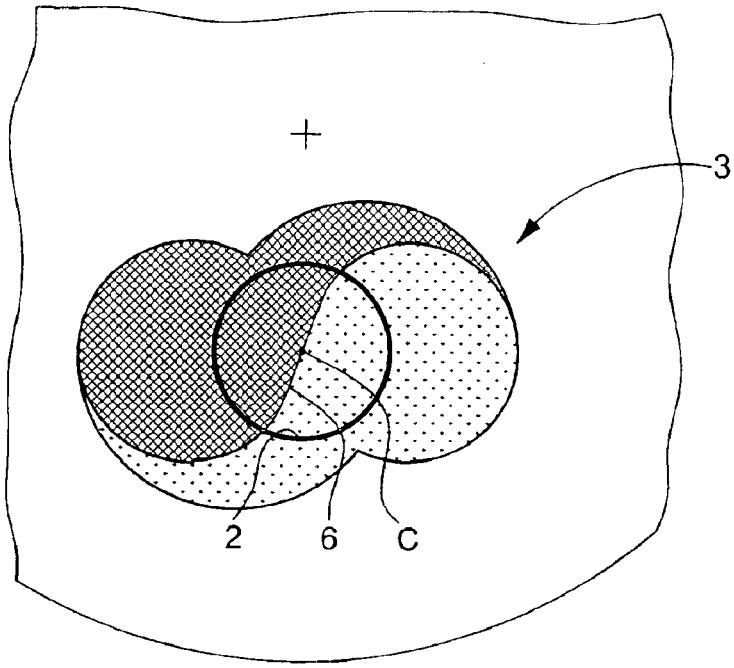

When the age of the moon reaches an eighth of a lunation, indicator 3 has the position shown in FIG. 6 and it gives an image of a crescent of waxing moon. The indicator continues to move without pivoting, until the first quarter phase shown in FIG. 7. The section of separation line 6 that is then visible in aperture 2 is substantially rectilinear, matching the real appearance of the moon in the first quarter.

At that moment, wheel 26 is unmeshed from wheel 21 and it is cams 30 and 31 that will then start the orientation of indicator 3, to make it pivot as was described hereinbefore. This pivoting can be seen in FIG. 8, which shows the waxing gibbous moon, and continues to the full moon position shown in FIG. 9, where only light zone 5 can be seen in aperture 2, whereas separation line 6 is no longer visible.

Figure 8:
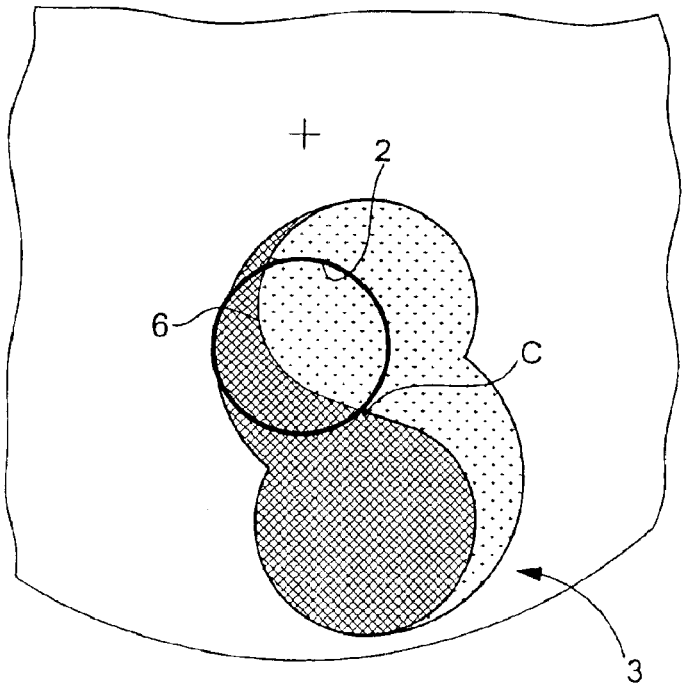
Figure 9:
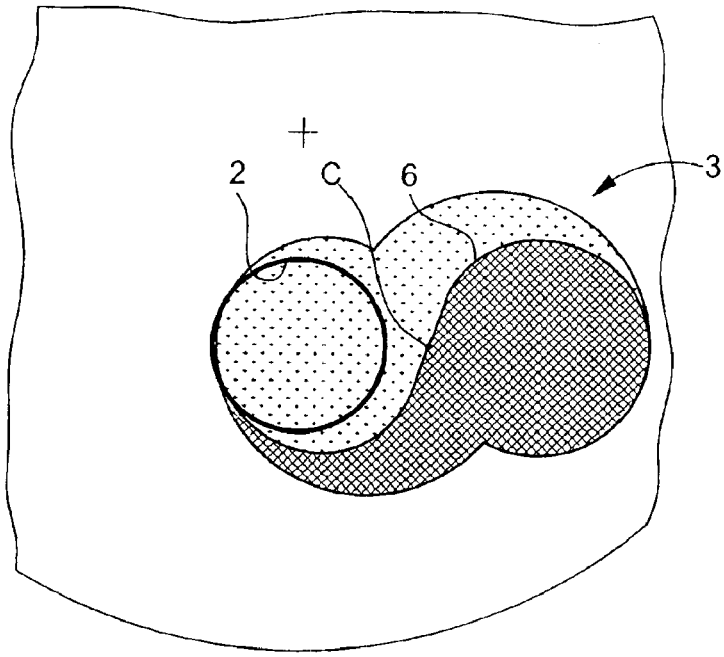
Figure 10:
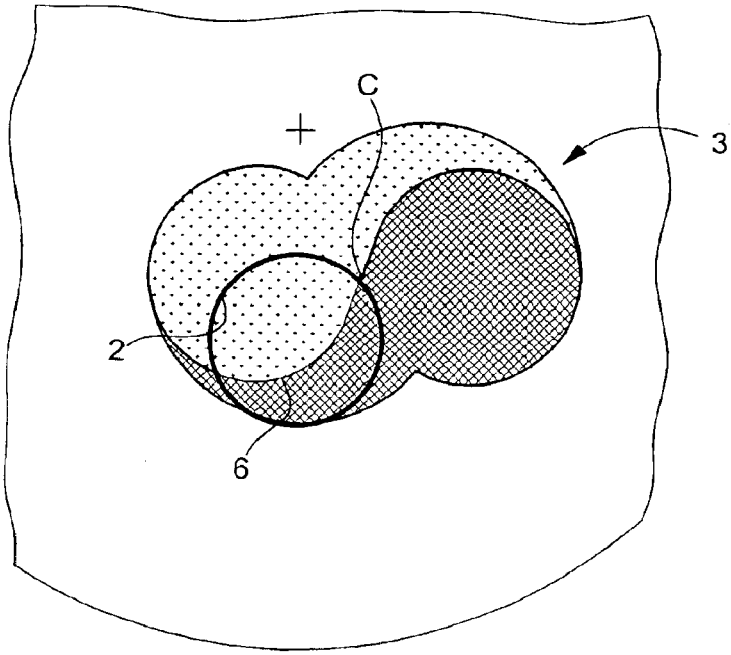
Figure 11:
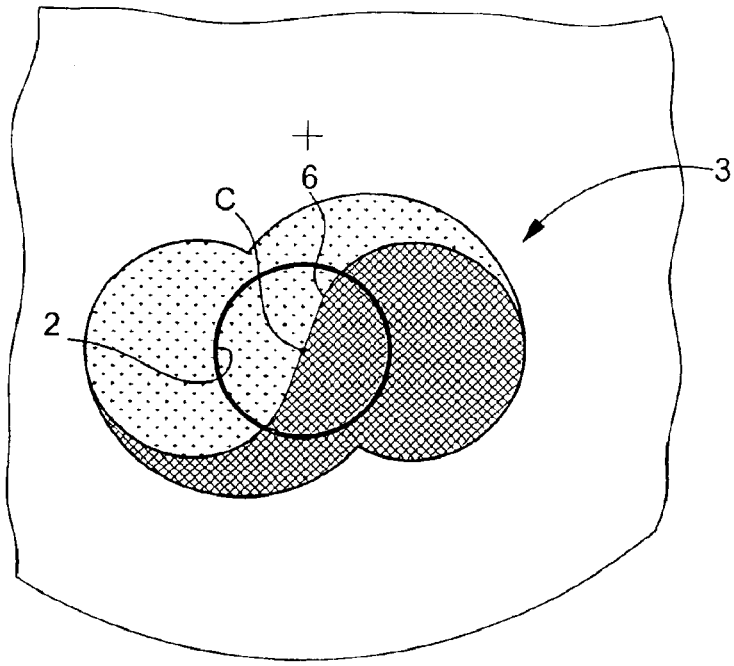

From the full moon, the first orientation means return to action to keep the orientation of indicator 3 constant in the waning gibbous moon phase shown in FIG. 11. In both FIGS. 8 and 10 showing the gibbous moon, it will be noted that the visible part of separation line 6 has a curvature matching reality and a shape that is close to the elliptical shape that is seen in the moon in reality.

Figure 12:
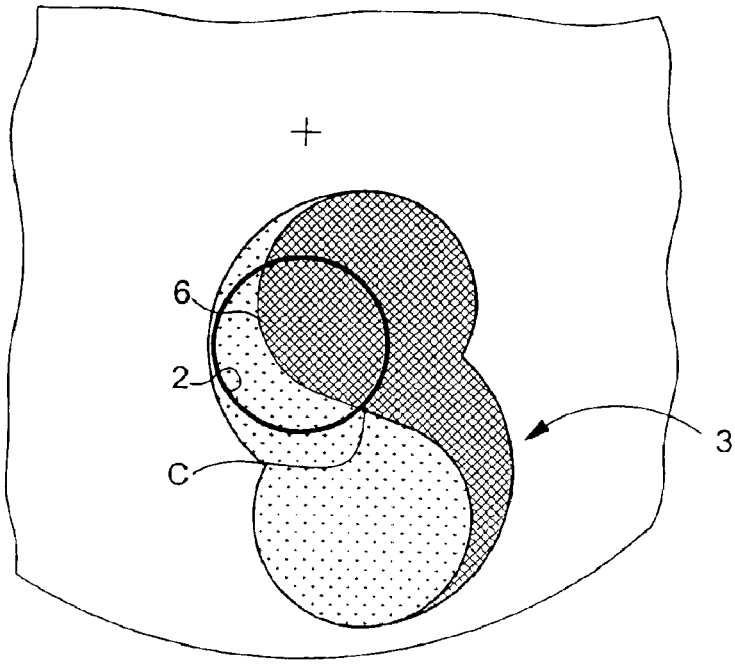

From the position of FIG. 11, indicator 3 is again oriented by the second orientation means and will thus carry out a half-revolution to the new moon phase shown in FIG. 5, passing through the position of FIG. 12 where its light zone 5 is visible in the shape of a crescent.

The preceding description and the drawings show that the configuration of indicator 3 and the movements that are imparted thereto by mechanism 4 allow images of the different phases of the moon, which are very close to the real appearance of the moon, to be displayed in aperture 2.

Moreover, the appearance of the displayed image is impeccable because the dark zone and the light zone of the image are located in the same plane, immediately behind the dial aperture. However, if no importance is attached to this feature, it is possible to remove for example dark zone 4 from indicator 3, which would then only have the shape of its light zone 5, and giving plate 16, which would then be visible in the aperture, a dark colour. Conversely, one could conserve only the dark zone of indicator 3 and give plate 16 a light colour.

In the embodiment shown, where indicator 3 includes both zones 4 and 5, plate 16 is never visible through the aperture and it could thus be replaced by a smaller support element, sufficient to carry bearings 16*a*, 18 and 24.

One could design a simplified version of the mechanism described hereinbefore, wherein indicator 3 pivots regularly with respect to the dial all the way through the lunation. One need only remove the second orientation means and replace toothed wheels 21 and 26 with a pair of complete toothed wheels having a transmission ratio of 1:2. However, such a system offers a less perfect match between the image displayed and the real appearance of the moon over time, the variation in the light zone displayed being too rapid in certain phases and too slow in others.

Two other embodiments will now be described, wherein the kinematics of indicator 3 can be substantially similar to that of the preferred embodiment, but obtained by means of different mechanisms.

Figure 13:
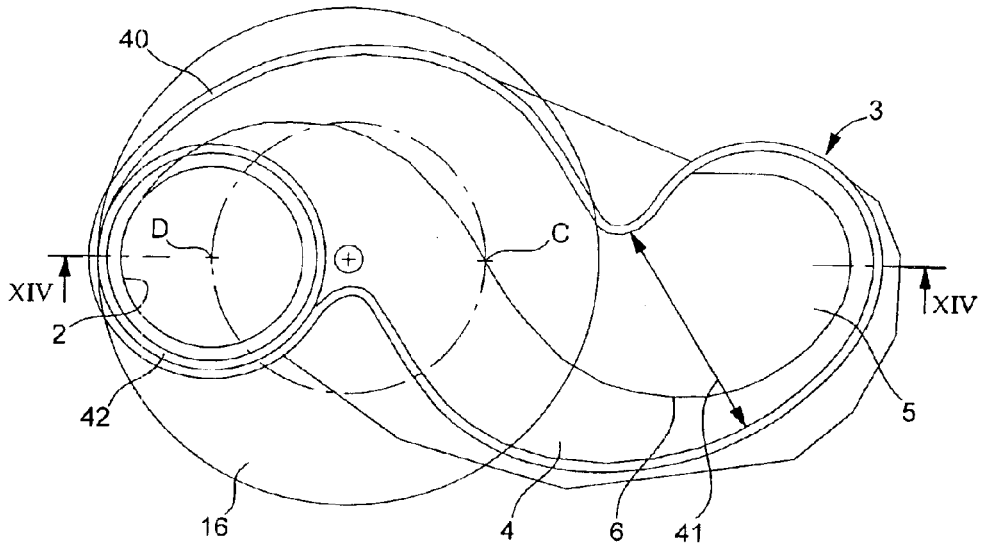
FIG. 13 is a plane view similar to that of FIG. 1, showing another embodiment of the mechanism of the display device.
Figure 14:
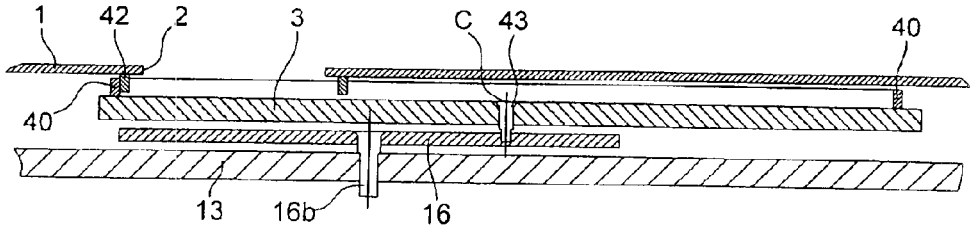
FIG. 14 is a schematic cross-section along the line XIV—XIV of FIG. 13.

In the version illustrated by FIGS. 13 and 14, indicator 3 carrying dark zone 4, light zone 5 and separation line 6 has substantially the same shape as in the preceding example and it is also mounted so as to pivot, at its centre C, on rotating support plate 16 by means of a shaft 43 or a ball bearing. According to FIG. 14, the plate 16 pivots on plate 13 by means of a shaft 16b driven by the watch movement, but the same function could be fulfilled by a ball bearing and a gear drive at the periphery as in FIGS. 1 and 2. The difference in fact lies in the orientation means for indicator 3. The latter includes on its upper face, along its external contour, a sinuous edge 40 that acts as a cam and defines a slide-way 41 of constant width having an S shaped outline. The lower face of dial 1 carries a fixed annular guide 42 located around the periphery of aperture 2 and engaged in slide-way 41, the external diameter of the guide being substantially equal to the width of the slide-way.

As in the preceding example, the rotation of plate 16 at the rate of two revolutions per lunation drives the centre C of indicator 3 over a circular trajectory 46, which passes through the centre D of aperture 2. The edge of cam 40 sliding against fixed guide 42 causes indicator 3 to pivot on the plate such that the movement of the indicator is similar to that described with reference to FIGS. 5 to 12.

Figure 15:
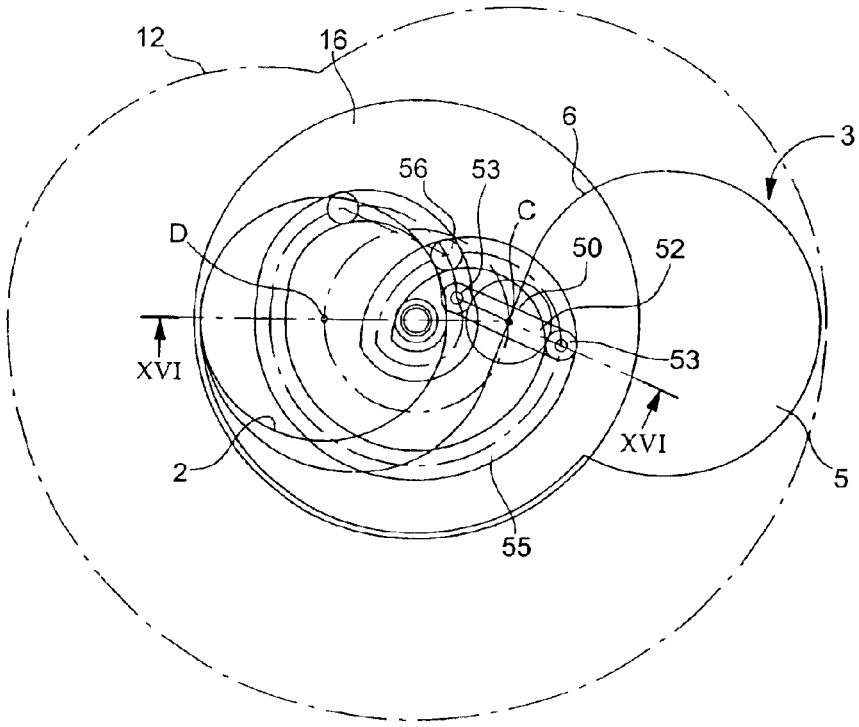
FIG. 15 is a similar plane view to that of FIG. 1, showing yet another embodiment of the mechanism of the display device.
Figure 16:
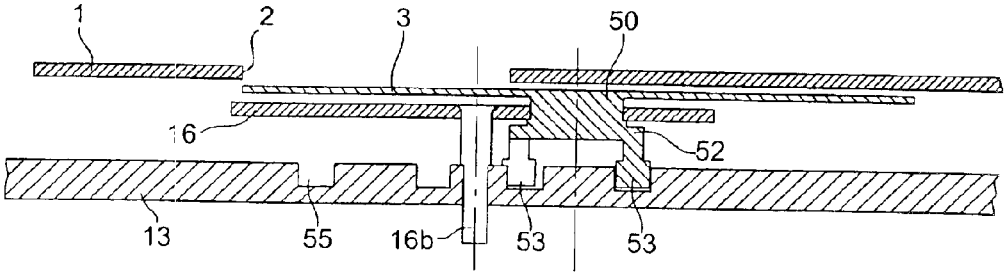
FIG. 16 is a schematic cross-section along the line XVI—XVI of FIG. 15.

In the version illustrated by FIGS. 15 and 16, indicator 3 carrying light zone 5 and separation line 6 (the dark zone has been omitted in order to clarify the drawing) has substantially the same shape as in the preceding examples and it is also mounted so as to pivot, at its centre C, on rotating support plate 16. The orientation means for indicator 3 are formed by a different cam system to that of the example of FIGS. 13 and 14, but producing substantially the same movements of the indicator.

At its centre C, indicator 3 includes a shaft 50 which passes through support plate 16, where it is mounted for example by a ball bearing that is not shown. Below plate 16, this shaft ends in a cross arm 52 bearing two cam followers formed by two pins 53 parallel to the shaft. These pins are engaged so as to slide in a cam groove 55 arranged in a fixed element, for example plate 13. The outline of groove 55, as can be seen in the drawing, is designed to produce the movements of the indicator that were described hereinbefore, while assuring that pins 53 follow the desired trajectory when they pass through the point of intersection 56 of the groove, but different outlines are also possible. One could also provide two distinct grooves, one for each pin. A single groove is enough here because the two pins 53 are arranged symmetrically with respect to the centre C of the line of separation 6 and the indicator.

It should be noted that the orientation means of the last two examples include in each case two complementary members formed respectively by a cam and one or more cam followers, one of the members being secured to the indicator and the other being stationary. This results in great simplicity of the transmission mechanism that drives the indicator.

What is claimed is:

1. Device for displaying the phases of the moon, particularly in a timepiece, including a dial provided with a circular aperture, a mobile indicator in the shape of a plate, moving behind the dial and having a substantially S-shaped line of separation between a dark zone and a light zone which can be seen through the aperture, said indicator having a pivoting axis which passes through a centre of symmetry of the line of separation, an entry element rotatably mounted on a plate and making a determined number of revolutions per lunation, and a transmission mechanism assuring a kinematic connection between the entry element and the indicator, wherein said transmission mechanism includes a rotating support making two revolutions per lunation and whose rotational axis is off-centre with respect to the aperture, wherein said indicator is mounted so as to pivot at one point of said rotating support whose trajectory passes through the centre of the aperture, and wherein said kinematic connection is arranged such that said indicator makes one revolution per lunation with respect to the dial.

2. Device according to claim 1, wherein the dark zone and the light zone are both located on the indicator.

3. Device according to claim 1, wherein the dark zone and/or the light zone each includes or include a substantially circular head, larger than the aperture, and a curved tail whose maximum length is approximately equal to the radius of the aperture.

4. Device according to claim 1, wherein the line of separation includes a substantially rectilinear section on which its centre of symmetry is located.

5. Device according to claim 1, wherein the movement of said indicator during one lunation includes a first and a third step during which the indicator moves substantially without rotating with respect to the dial, and a second and a fourth step during each of which the indicator moves by rotating substantially through a half-revolution with respect to the dial.

6. Device according to claim 5, wherein said kinematic connection includes first orientation means with gears for maintaining the orientation of the indicator during said first and third steps, and second orientation means with cams, for causing the indicator to pivot with the rotating support during said second and fourth steps.

7. Device according to claim 6, wherein said first orientation means include gears which cause the indicator to pivot by a half-revolution in one direction on the rotating support while the latter makes a half-revolution in the opposite direction.

8. Device according to claim 1, wherein said kinematic connection includes cam orientation means, including a fixed guide arranged around the periphery of the aperture and engaged in a sinuous slide-way defined by a cam edge on said indicator.

9. Device according to claim 1, wherein said kinematic connection includes cam orientation means, including at least one cam groove arranged in a fixed element and at least two cam followers secured to said indicator and engaged so as to slide in said grooves.

* * * * *